US006915991B1

(12) United States Patent
Shomer et al.

(10) Patent No.: US 6,915,991 B1
(45) Date of Patent: Jul. 12, 2005

(54) BOTTLE RETAINER FOR A BABY

(76) Inventors: Helena Shomer, 3455 Twilight Star, Las Vegas, NV (US) 89117; Bobby Shomer, 3455 Twilight Star, Las Vegas, NV (US) 89117

( * ) Notice: Subject to any disclaimer, the term of this patent is extended or adjusted under 35 U.S.C. 154(b) by 0 days.

(21) Appl. No.: 10/231,919

(22) Filed: Aug. 29, 2002

(51) Int. Cl.[7] ..... A47D 15/00
(52) U.S. Cl. ..... 248/106
(58) Field of Search ..... 24/535, 537; 248/105, 248/106, 102, 104, 107

(56) References Cited

U.S. PATENT DOCUMENTS 1,531,176 A * 3/1925 Cmejla ..... 24/537
1,575,590 A * 3/1926 Limpright ..... 24/522
2,717,753 A * 9/1955 Schweikert ..... 248/106
2,856,145 A * 10/1958 Richardson ..... 248/106
4,015,505 A * 4/1977 Murray ..... 411/80.6
4,315,654 A * 2/1982 Crook ..... 297/188.2
4,858,249 A * 8/1989 Stewart ..... 2/305
5,037,046 A * 8/1991 Mingledorff, Jr. ..... 248/106
5,769,367 A * 6/1998 Bradley et al. ..... 248/102
5,979,843 A * 11/1999 Beck ..... 248/102
6,126,129 A * 10/2000 Herron ..... 248/311.3

FOREIGN PATENT DOCUMENTS

JP 2000-23824 * 1/2000

OTHER PUBLICATIONS

EP 0 966 900 A1, to Morito Co, publication date Dec. 12, 1999.*

* cited by examiner

*Primary Examiner*—Ramon O Ramirez
(74) *Attorney, Agent, or Firm*—Leonard Weiss

(57) ABSTRACT

A manually bendable strip is made from a stainless steel ribbon within a vinyl sheath. The sheath with the stainless steel ribbon are encased within a casing made from a soft fabric. A central region of the strip is a bottle holder in the shape of an open ended ring. Ends of the ring form tongs that can fit onto a baby's torso. A fabric strip is tied about a junction formed by the bottle holder and the tongs.

1 Claim, 1 Drawing Sheet

BOTTLE RETAINER FOR A BABY

BACKGROUND OF THE INVENTION

1. Field of Invention

This invention is in the general field of infant care and, more particularly, is an apparatus for supporting a baby bottle in a manner that allows a baby to feed from the bottle.

2. Description of the Prior Art

There are a multiplicity of devices in the prior art for holding a baby bottle in a particular orientation. Examples of these prior art devices are provided by the following patents:

| U.S. Pat. No. | Inventor |
|---|---|
| 6,402,099 | Hughes |
| 5,613,657 | Olaiz |
| 4,989,811 | Millis et al. |
| 4,951,997 | Kenney |
| 4,315,654 | Crook |
| 4,121,797 | MacNeil |
| 3,298,649 | Paglee |
| 2,628,802 | Wahlberg |
| 2,514,134 | Mann |
| 2,362,020 | Morrow |
| 1,863,163 | Malti |
| 1,826,810 | Morshita |

Typically, the baby is positioned in any of a plethora locations, such as a car seat, a crib or a stroller where the baby drinks from the bottle. When the baby has underdeveloped motor skills or an insufficient attention span, there is a need for a child care provider to hold the bottle. Alternatively, apparatus disclosed in the above mentioned patents can be used for holding the bottle.

None of the above mentioned patents disclose supporting the baby bottle when the baby is in any one of a multiplicity of positions. Additionally, none provide safe and sanitary feeding of the baby so that, for example, a child-care provider can attend to other tasks while the baby is fed nearby.

SUMMARY OF THE INVENTION

An object of the present invention is to provide safe and sanitary feeding of a baby unassisted by a child care provider.

According to the present invention, a manually bendable strip has a central region in the general shape of an open ended ring. Ends of the ring are integrally connected to tongs that are manually bendable. A fabric strip is tied about a junction of the ring and the tongs.

The invention-provides a baby feeding apparatus for feeding a baby that is typically three to six months old. The baby is protected from irritating contact with the apparatus by a fabric that encases all parts that may be an irritant.

Other objects, features and advantages of the invention should be apparent from the following description of embodiments thereof as illustrated in the accompanying drawing.

DESCRIPTION OF THE PREFERRED EMBODIMENT

Figure 1:
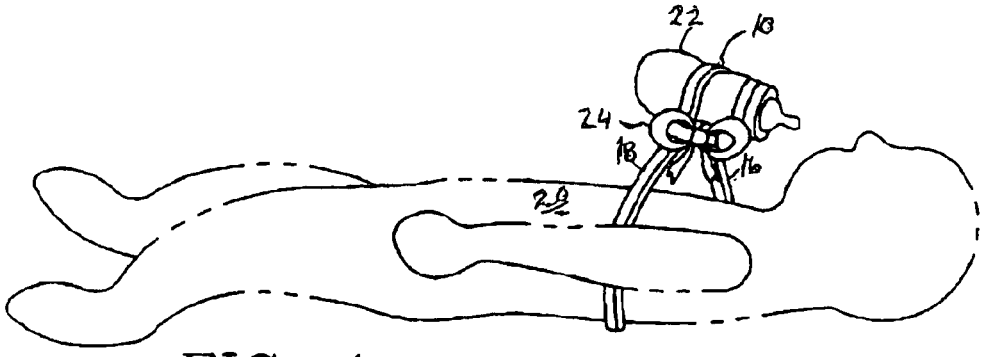
FIG. 1 is a perspective view of the preferred embodiment of the invention connected to a baby.
Figure 2:
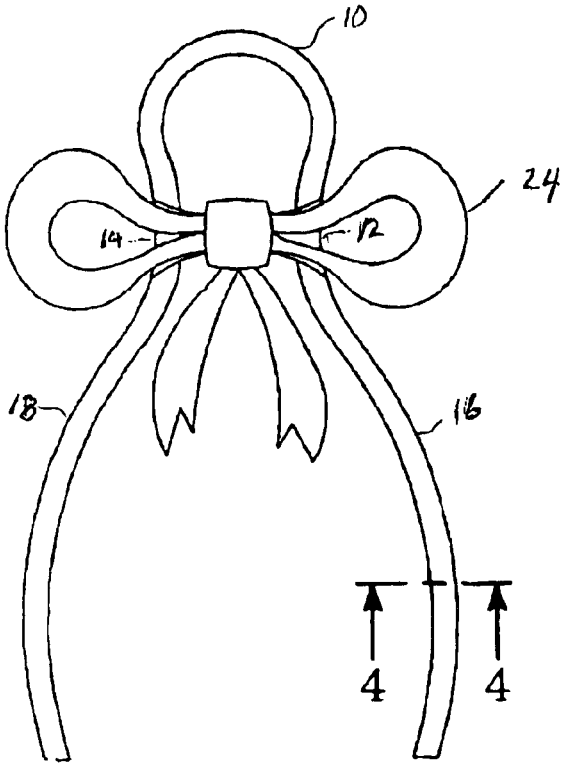
FIG. 2 is a plan view of the preferred embodiment of the invention.

As shown in FIGS. 1 and 2, a baby bottle holder 10 has the general shape of an open ended ring. The bottle holder 10 is formed from a central portion of a manually bendable strip.

The bottle holder 10 has ends 12, 14 (FIG. 2) that are integrally connected to parts of the strip that form tongs 16, 18, respectively, that fit about the torso of a baby 20 (FIG. 1). A fabric strip 24 is tied about a junction formed by the ends 12, 14 and the tongs 16, 18. Because of the strip 24, unwanted separation of the ends 12, 14 is prevented whereby a bottle 22 is retained by the bottle holder 10 and tongs 16, 18 are retained about the torso of the baby 20.

It should be understood that because the bottle holder 10 and the tongs 16, 18 are made from the manually bendable strip, adjustments can be readily made to position the bottle 22 so that it is easily reached by the baby 20 when in any one of a multiplicity of positions.

Figure 3:
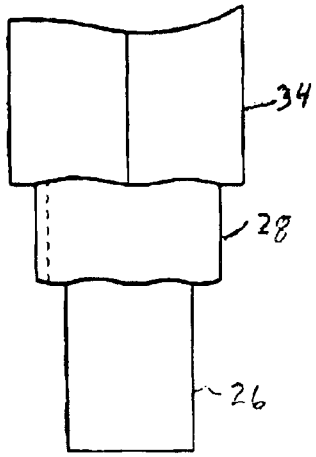
FIG. 3 is an enlarged view of an end of a manually bendable clamp of FIG. 2 with parts broken away.
Figure 4:
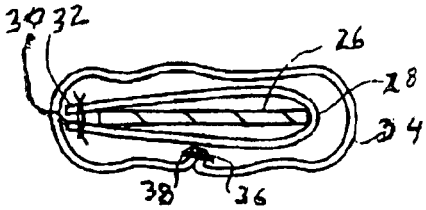
FIG. 4 is a view of FIG. 2 taken along the line 4—4.

As shown in FIGS. 3 and 4, the manually bendable strip has a central part which is a bendable stainless steel ribbon 26. A vinyl sheet 28 has edges 30, 32 that are sewn together to form a sheath wherein the ribbon 26 is disposed. A soft woolen fabric 34 has edges 36, 38 that are sewn together to form a casing wherein the sheet 28 and the ribbon 26 are encased. The fabric 34 prevents the vinyl 28 from irritating the baby 20.

While the invention has been shown and described with reference to a preferred embodiment thereof, changes in form and detail may be made therein without departing from the spirit and scope of the invention.

We claim:

1. A bottle retainer for a baby, comprising:

a baby bottle holder, in the general shape of an open ended ring, formed from a central region of a bendable ribbon; and two tongs that are respectively connected to ends of said ring wherein said tongs are made from ends of said ribbon extending from said bottle holder, said tongs being adapted to fit about the torso of a baby; and a fabric strip that is tied about a junction formed by said bottle holder and said tongs to prevent unwanted separation of the ends to retain a bottle and to retain the tongs about the torso of the baby.

* * * * *